United States Patent [19]

Petersson et al.

[11] Patent Number: 4,773,809

[45] Date of Patent: Sep. 27, 1988

[54] DEVICE IN A STORAGE SYSTEM

[75] Inventors: Tomas H. Petersson, Helsingborg; Lars Magnusson, Glumslöv; Alve S. Steinfeldt, Viken, all of Sweden

[73] Assignee: Electrolux Constructor Aktiebolag, Sweden

[21] Appl. No.: 466,344

[22] PCT Filed: Jun. 10, 1982

[86] PCT No.: PCT/SE82/00204

§ 371 Date: Jan. 31, 1983

§ 102(e) Date: Jan. 31, 1983

[87] PCT Pub. No.: WO82/04431

PCT Pub. Date: Dec. 23, 1982

[30] Foreign Application Priority Data

Jun. 10, 1981 [SE] Sweden ..... 8103641

[51] Int. Cl.[4] ..... B65G 1/10

[52] U.S. Cl. ..... 414/331; 104/134; 312/201

[58] Field of Search ..... 414/331, 284, 279, 281, 414/282, 277; 312/198–201; 104/134, 135, 48

[56] References Cited

U.S. PATENT DOCUMENTS

| | | | |
|---|---|---|---|
| 3,921,828 | 11/1975 | Suizu | 414/281 X |
| 3,924,300 | 12/1975 | Hilger et al. | 414/281 |
| 3,977,542 | 8/1976 | Stolzer | 414/331 |
| 4,229,135 | 10/1980 | Malmros | 414/284 |
| 4,259,907 | 4/1981 | Schuck | 104/135 X |

FOREIGN PATENT DOCUMENTS 2742970 4/1979 Fed. Rep. of Germany .

*Primary Examiner*—Robert J. Spar
*Assistant Examiner*—David A. Bucci
*Attorney, Agent, or Firm*—Alfred E. Miller

[57] ABSTRACT

A device in the storage system having movable units placed one beside the other and provided with shelves, the units being movable sidewise on tracks in order to form a passage between two units movable in opposite directions, the passage allowing access to the units, and a handling device movable into said passage for loading or unloading of articles into and out of the units. The tracks carrying the movable units are composed of interspaced sections placed on the floor which are provided with upwardedly directed support wheels or rollers, and that in the interspaces uninterrupted rails extend therein upon which said handling devices are movable.

5 Claims, 1 Drawing Sheet

DEVICE IN A STORAGE SYSTEM

Figure 1:
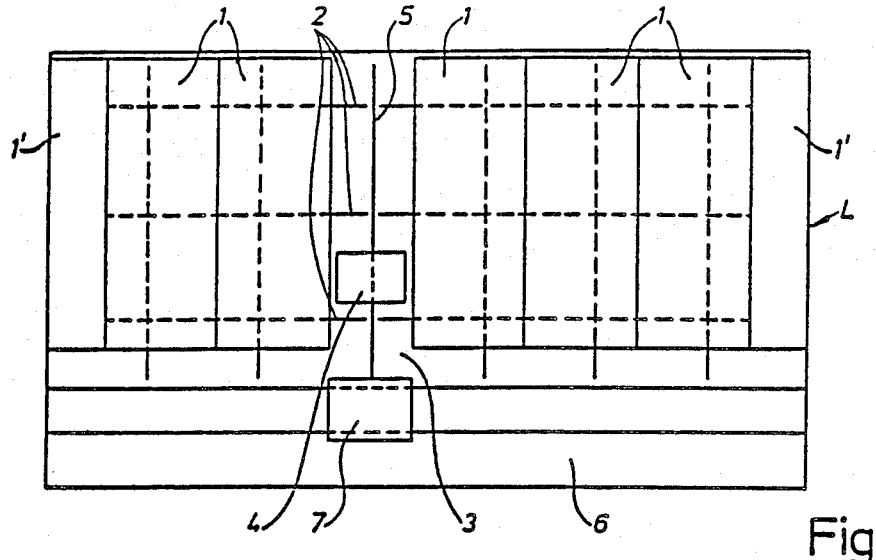

This invention relates to a device in a storage system comprising several units placed one beside the other and provided with shelves or other supports, the units being movable sideways on tracks in order to form a passage between two units moved in opposite directions, the passage allowing access to these two units, and a means movable into such a passage for loading or unloading of articles or goods into or out of the units concerned.

Mobile units for instance for storing of articles on pallets or of other uniform items are common. When there is no need for such units to be accessible they stand close together and usually only one passage is open in each group of mobile units. Thus, the space in the storing premises can be used in a far more effective way than by storing on fixed shelves or units. Especially in freezing houses and the like in which it is desired to use as large a part as possible of the volume for storing, mobile storing units are particularly advantageous. Conventional storage systems having mobile units are usually built for loading and unloading by means of fork trucks, and trucks of this type which are moved on the floor require comparatively broad passages between the units. Latterly, in storage premises with fixed units, rail-guided handling devices have been used which by cranes or trucks can be moved on rails in narrow passages between the fixed units. Because of the tracks need for moving the units, storage systems having mobile cranes or trucks guided on rails in the floor cannot be used, since crossing rail systems cannot be allowed.

It is desirable that old freezing houses which are equipped with fixed storing units or shelves in a simple way could be rebuilt for mobile storage units. With today's technique this is difficult and expensive since recesses in the floor for the tracks of the units, which are necessary for handling by means of floor-running trucks, cannot be made without causing an increased temperature in the freezing house. The recesses are usually obtained by applying a casting to the floor up to the upper surface of the rails, since in most cases the floor construction does not allow the tracks to be sunk in the floor, and this results in differences in level of the different premises. Also after such a rebuilding the freezing house would not be suited for handling by means of rail-guided handling devices because of the crossing rails. It is further desired that such handling should be possible.

The object of this invention is to provide a device for storage systems of the type described with a device that requires a minimum of changes in the floor of the building and makes it possible to use rail-guided handling cranes.

The essential characteristics of the device according to the invention are that the tracks carrying the movable units are composed of interspaced sections placed on the floors or the like which are provided with upwardly directed support wheels or rollers, and that in the interspaces uninterrupted rails extend for a handling device, known per se.

Generally, the invention solves the problem of eliminating crossing tracks for the load-carrying units and the handling device, i.e. piling cranes and narrow-gauge lifting trucks.

The invention also solves the problem in existing freezing houses and similar premises of arranging rails for handling devices as well as tracks for the load-supporting storing units without the ones influencing the others. Also, the installation can be made without increasing the temperature in the freezing house or making arrangements in the floor of the freezing house other than normal fastening operations.

Figure 2:
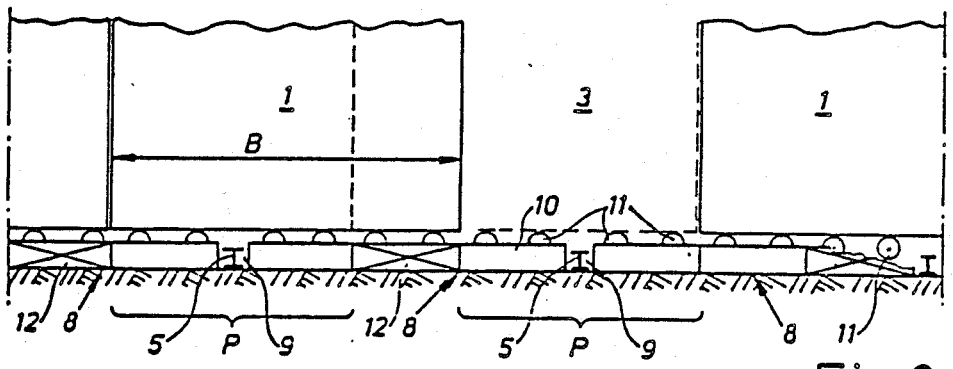
Figure 3:
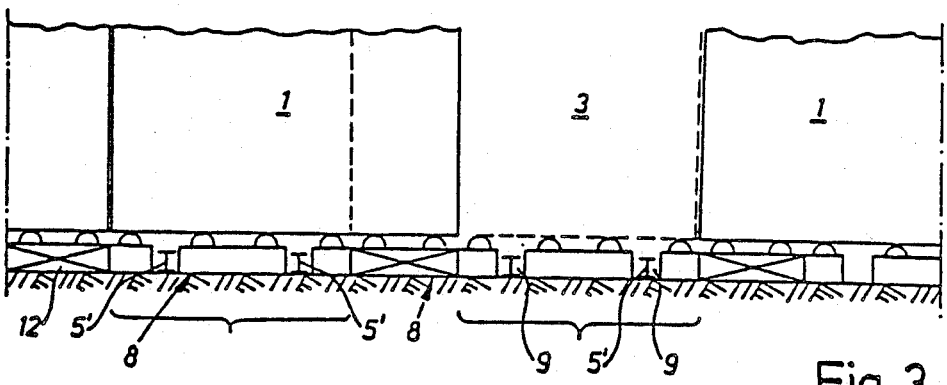

Embodiments of storing systems according to the invention will now be described with reference to the accompanying drawing, in which FIG. 1 schematically shows a storage system according to the invention, seen from above, and FIG. 2 to an enlarged scale shows a portion of the lower part of mobile units and track system for these units, seen in a direction perpendicular to the direction of movement of the units, in an embodiment suited for cranes supported on a single rail, and FIG. 3 shows the same embodiment as FIG. 2 but intended for cranes or trucks supported on two rails.

In the premises L, which can be a freezing house, several storing units 1 are arranged. The units 1', which are close to the end walls, ae as a rule fixed whereas the units therebetween are movable on tracks 2 arranged on the floor. When moving some units to the right and the other units to the left, a passageway 3 is formed into which a handling device 4 can be moved to load or unload goods into or out of the units adjacent the passageway 3. The handling device - is a rail-supported piling crane or a truck which runs on one rail 5, according to the embodiment of FIG. 1, or on two rails 5', into an opened passageway 3. The handling device 4 can be moved sideways by means of a sliding table 7 running on a rail or the like in the free spaces 6 in front of the units 1.

According to the invention the tracks for the movable units are formed by several aigned sections 8 having interspaces 9 in which rails 5 and 5' for the handling crane or the truck 4 extend. In the preferred embodiment each one of the track sections comprises a frame or box 10 which is fastened to the floor and has several support wheels 11 or rollers. At the underside of each movable unit 1 there is a rail or the like which rests on the support wheels 11.

In the embodiment shown each one of the movable units 1 is broader than the possible width of the passage between the units. This means that a middle part 12 of each track section 8 always will be located under a unit 1 and that at said middle part a drive means of simple design can be installed for the movement of the unit towards one side or the other.

In FIG. 2, the measures P show the feasible width of the passage and the measures B the width of the movable units. The location of a unit moved to the left-hand position is shown by full lines and the location of the same unit is shown by dotted lines in the right-hand position. It appears from FIG. 2 that the middle part 12 of the track section 8 will always be located under or be overlapped by the unit 1. Thus a drive means, for instance a cylinder-piston device, can always be connected between the unit and the middle part of the track section.

The single-rails 5 intended for the handling crane are placed in the interspaces 9 between each section 8 and these interspaces are located in alignment with the position indicated by P for each possible passageway 3. The rails 5 extend uninterrupted past each track 2 and allow smooth movement. Handling cranes of this type need a further support in the form of an upper rail, which is not shown.

The embodiment according to FIG. 3 is intended for handling devices in the form of trucks running on two rails. Thus, for this purpose two rails 5' are arranged in the interspaces 9 between the track sections 8. The construction of the track sections according to the embodiment of FIG. 3 roughly corresponds to that according to the embodiment of FIG. 2 apart from the facts that the portion including the middle part is shorter and that one part of the track section is placed between the rails 5'. From a functional point of view there is no important difference. Also in this embodiment a drive means can be placed at the middle part of the track section and be connected to the unit resting on the section.

The invention should not be regarded as being limited to what has been described and shown in the drawing but can be modified in many ways within the scope of the following claims.

We claim:

1. In an arrangement in a storage system for articles, provided with a floor and having at least a pair of storage units positioned side by side and provided with supports such as shelves, and movable laterally in opposite directions to form a passageway permitting access to said two storage units, the improvement comprising:

a plurality of wheels rotatably mounted on stationary means which rest on said floor, said wheels supporting said storage units which are movable thereon, said stationary means abutting each other end to end except for at least one interspace therebetween, an uninterrupted rail in said interspace extending substantially perpendicular to the path of movement of said storage units, and a handling device movable forwards and backwards on said rail for loading and unloading said articles into or out of said storage units.

2. A device as claimed in claim 1 wherein said wheels are mounted upon the top surface of said stationary means and are upwardly directed.

3. A device as claimed in claim 1 wherein said stationary means include a middle part which is always overlapped by one of said units, and said units are movable to a displacement which is less than the width of said unit.

4. A device as claimed in claim 1 wherein there are two interspaces, and a separate rail arranged in each of said interspaces.

5. A device as claimed in claim 1 wherein said rail is fixed directly on said floor, and between said wheels

* * * * *